US006298913B1

(12) United States Patent
Box

(10) Patent No.: US 6,298,913 B1
(45) Date of Patent: Oct. 9, 2001

(54) EXPLOSIVE PIPE CUTTING DEVICE

(75) Inventor: Wade L. Box, Burleson, TX (US)

(73) Assignee: The Ensign-Bickford Company, Simsbury, CT (US)

( * ) Notice: Subject to any disclaimer, the term of this patent is extended or adjusted under 35 U.S.C. 154(b) by 0 days.

(21) Appl. No.: 09/383,788

(22) Filed: Aug. 26, 1999

(51) Int. Cl.[7] ..... E21B 29/00
(52) U.S. Cl. ..... 166/55; 166/63; 175/4.6
(58) Field of Search ..... 166/55, 55.2, 55.6, 166/55.7, 63; 175/4.6, 3.5

(56) References Cited

U.S. PATENT DOCUMENTS 4,184,430 * 1/1980 Mock ..... 102/307
5,014,780 * 5/1991 Skipper ..... 166/55.8
5,054,555 * 10/1991 Lalande et al. ..... 166/298
5,129,322 * 7/1992 Christopher et al. ..... 102/202.3
5,816,343 * 10/1998 Markel et al. ..... 166/55 X
5,992,289 * 11/1999 George et al. ..... 89/1.15
6,029,745 * 2/2000 Broussard et al. ..... 166/298

* cited by examiner

*Primary Examiner*—Frank Tsay
(74) *Attorney, Agent, or Firm*—Libert & Associates; Victor E. Libert; Frederick A. Spaeth

(57) ABSTRACT

An explosive pipe cutter assembly (10, 10') has a housing (20, 20') which defines at its closed end a hemispherical shaped nose end (22, 22') and contains a toroidal shaped charge (48) comprised of two half-charges (42). Toroidal shaped charge (48) has a seating surface (31) seated on a support shoulder (50, 50') adjacent the closed end of the housing (20, 20'), and a trailing end which is engaged by a retaining ring (38) received in the open end (24, 24') of the housing (20, 20'). Two juxtaposed half-liners (28) provide a liner having an apex (A) which is curved in longitudinal cross section to increase the mass of the metal formed into a penetrating jet by detonation of the shaped charge (48). The hemispherical shape of the nose end (22, 22') of the housing (20, 20') provides increased pressure resistance for a given wall thickness and material of construction, and is better able to navigate past obstacles while being lowered through a well than are conventional flat-nose housings.

16 Claims, 6 Drawing Sheets

EXPLOSIVE PIPE CUTTING DEVICE

BACKGROUND OF THE INVENTION

1. Field of the Invention

The present invention relates to an explosive pipe cutting device for severing pipe, such as drill pipe and tubing used in oil wells, natural gas wells and other types of wells.

2. Related Art

It is often desirable to retrieve pipe, tubing and the like (below referred to as "pipe") from deep within a well, such as an oil well which is being closed or abandoned. Such pipe may extend for many tens of thousands of feet into the well and, in some cases, is made of expensive, high strength steel. Consequently, the ability to retrieve and reuse such pipe provides a very considerable cost savings as well as recycling a non-renewable resource. Retrieval is accomplished by cutting the pipe deep below the surface with an explosive shaped charge and withdrawing for re-use the portion of the pipe above the point at which it was cut. The amount of savings to be attained increases with increasing depth of the well. As the depth within the well increases, however, there is a concomitant increase in both (1) the pressure and temperature at which the explosive pipe cutting device must function and (2) the length of pipe which must be navigated by the pipe cutting device as it is lowered into the well to the point at which the pipe is to be severed. Typical explosive pipe cutting devices comprise a housing within which is contained an explosive shaped charge having in the known manner a metallic liner on their concave surfaces. In addition to the shaped charge, the housing typically contains a booster explosive to reliably initiate the shaped charge, an initiation device to reliably initiate the booster explosive, and an end plate serving to securely retain the components within the metal housing. The metal housing serves to protect and enclose the shaped charge and other components. The explosive cutting device is connected to a "wireline string" which is utilized to lower the cutting device to the desired depth, which may be ten thousand feet or more, at which depth the pipe is to be cut. The wireline string typically comprises a braided steel outer jacket which provides mechanical strength and has an electrically insulative core through which wire conductors pass to transmit, in response to a signal generated at the surface, electrical energy to a detonating fuze contained within the housing and associated with the booster charge. Electric current passed through these conductors initiates the detonating fuze, which detonates the booster charge, which in turn detonates the shaped charge to attain the explosive cutting effect.

The housings of known explosive pipe cutting devices are usually made of hardened steel, are of circular cylindrical configuration, and terminate in a flat lower end or nose portion. For example, a conventional housing might be machined from a solid steel circular bar into a cup shape with the closed (nose) end of the cup in the configuration of a flat disk. Such cylindrical shaped housings are relatively inefficient in resisting the pressure encountered in deep wells, and therefore require a large wall thickness for a given level of pressure, especially of the nose end, which is made thicker than the walls of the circular cylinder. The large wall thickness adds to the amount of hardened steel debris deposited in the well bore upon detonation of the shaped charge. Further, the flat nose housings are difficult to maneuver around obstructions in the well.

Typical shaped charges of known construction for use in severing pipes are of toroidal configuration with a metal-lined, circumferential concave opening extending about the outer periphery of the toroidal structure. As is well-known to those skilled in the art, the metal liner increases the mass of the high velocity explosive jet generated by the shaped charge. The toroidal configuration is attained by positioning two annular half-charges together so that each annular half-charge provides one-half of the finished toroidal shaped charge, the two half-charges being symmetrical about a plane passed through the apex of the concave, circumferential opening perpendicularly of the longitudinal axis of the toroidal shaped charge. Prior art toroidal shaped charges utilize an annular metallic ring on each half-charge which, when the two halves are joined together, define a metal liner having a V-shaped cross section and lining the concave circumferential opening of the assembled shaped charge. It would be advantageous to enhance the penetrating power of the shaped charge by improving the design of the liner to increase the metal mass at the apex of the liner.

Another problem in the art is to properly align the halves of the shaped charge because the alignment thereof determines the symmetry of the two half-charges which is critical to enhancing the penetrating power of the explosive jet and hence its reliability in effecting a complete break in the pipe.

SUMMARY OF THE INVENTION

In accordance with the present invention, there is provided an explosive pipe cutting device. The pipe cutting device comprises a housing which defines an enclosure and has a closed end and an opposite, open end. The closed end defines a nose end which terminates in a terminus and has an exterior surface which is of tapered configuration and which diminishes in diameter in the direction moving towards the terminus of the nose end. For example, the nose end may define an exterior surface of curved configuration, e.g., it may be of hemispherical configuration. Optionally, the nose end may comprise a part of a major segment of a sphere. A toroidal shaped charge is disposed within the housing and has a front surface facing the nose end, an opposite, trailing surface facing the open end and a radially outwardly facing concave surface between the front surface and the trailing surface. A retaining ring is connected to the open end of the housing so as to secure the toroidal shaped charge within the housing.

In one aspect of the present invention, the closed end of the housing defines an interior seating surface on which the front surface of the toroidal shaped charge is seated.

In another aspect of the present invention, a retaining ring is disposed within the housing adjacent to the open end thereof, the retaining ring engaging the trailing surface of the toroidal shaped charge.

Another aspect of the present invention provides for the toroidal shaped charge to have a toroidal metal liner lining the concave surface thereof, the metal liner being dimensioned and configured to exhibit in longitudinal cross-sectional view a V-shape having a curved apex.

Yet another aspect of the present invention provides that the toroidal shaped charge is comprised of a pair of half-charges having mating surfaces and being juxtaposed to each other at their respective mating surfaces. In a related aspect of the present invention, each of the half-charges has a metal half-liner lining a surface thereof, the metal half-liners being dimensioned and configured whereby when the half-charges are juxtaposed to each other within the housing to provide the toroidal shaped charge, the two metal half-liners cooperate to define a metal liner which lines the concave surface of the shaped charge and which is dimensioned and configured to exhibit in longitudinal cross-sectional view a V-shape having a curved apex.

Another aspect of the present invention provides a housing for an explosive pipe cutting device. The housing has a closed end and an opposite open end, the closed end defining a nose end which terminates in a terminus and has an exterior surface which is of tapered configuration, e.g., hemispherical, and which diminishes in diameter in the direction moving towards the terminus of the nose end. The other characteristics of the housing are as described above with respect to the housing of the explosive pipe cutting device.

DETAILED DESCRIPTION OF THE INVENTION AND PREFERRED EMBODIMENTS THEREOF

Figure 2:
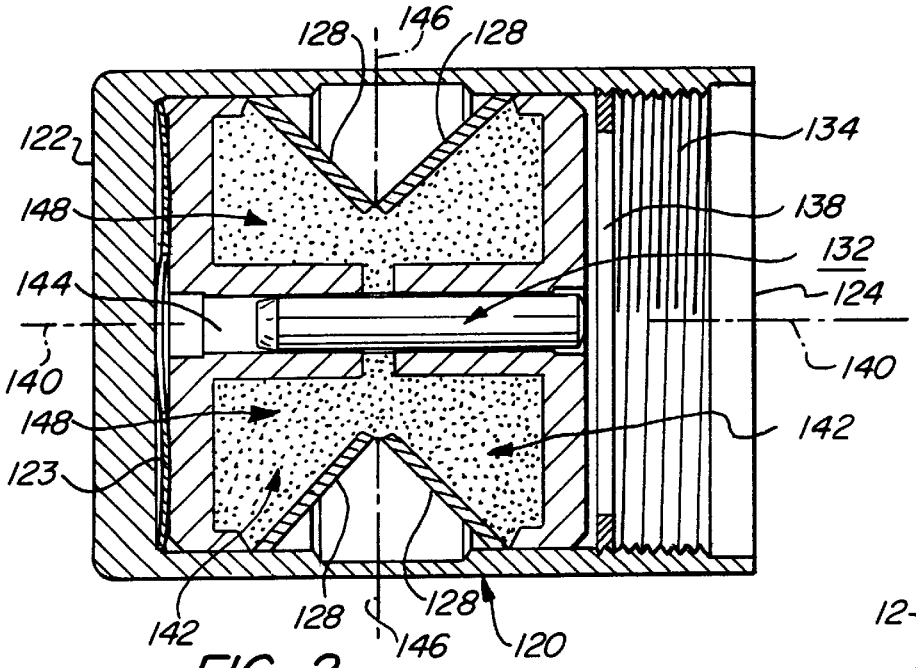
FIG. 2 (PRIOR ART)
FIG. 2 is a cross-sectional view of an explosive pipe cutting device of the prior art comprising two of the prior art half-charges of FIG. 1 contained within a prior art housing.
Figure 1:
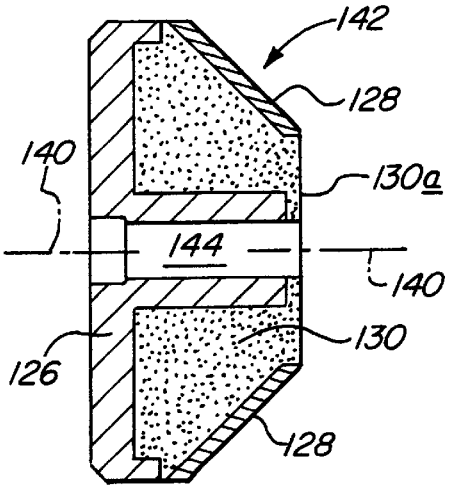
FIG. 1 (PRIOR ART)
FIG. 1 is a cross-sectional view in elevation of a half-charge of the prior art used in the prior art device of FIG. 2.

Before describing the devices of the present invention, it will be useful to briefly describe a typical explosive pipe cutting device of the prior art. Referring to FIG. 1, there is shown in cross-sectional view a half-charge 142 of the prior art comprised of a half-liner 128 which is configured as a hollow, truncated cone and lines one side of an explosive charge 130 which is also of truncated conical shape and has a minor surface 130*a*. The opposite side of explosive charge 130 has affixed to it, by a suitable adhesive, a backup plate 126. Backup plate 126 and explosive charge 130 both have a central aperture extending therethrough to provide a passageway 144 which is coaxial with the center longitudinal axis 140 of half-charge 142. Half-charge 142, as shown in FIG. 2, is juxtaposed with another, identical half-charge 142 at their respective minor surfaces 130*a* (FIG. 1). The respective, mating minor surfaces 130*a* of the two half-charges 142 abut in a transverse plane 146. Such juxtaposition of the two half-charges 142 provides a toroidal shaped charge 148 which is received within a housing 120 having a closed, nose end 122 and an open end 124 to provide a prior art explosive pipe cutting device 110. Open end 124 is closed by a retaining ring 138 which is received within a circumferential groove (unnumbered) formed in the interior surface of housing 120 and located adjacent the inside edge of threaded portion 134. A conventional wave washer spring 123 is compressed between toroidal shaped charge 148 and the interior surface of nose end 122 to force toroidal shaped charge 148 against retaining ring 138. The pipe cutting device of FIG. 2 is connected by threaded portion 134 to a suitable adapter (not shown) for lowering into a well pipe or the like to be severed.

Half-charges 142 are configured to provide, when juxtaposed to each other as shown in FIG. 2, a longitudinally-extending passageway 144 within which a booster charge assembly 132 is contained. Suitable connections, not shown, extend from the surface down the well to a detonator, not shown in FIG. 2, to initiate the same when housing 120 is properly positioned within a well pipe or the like. Booster charge assembly 132 will in turn detonate toroidal shaped charge 148 to provide an explosion, the main thrust of which will emanate radially outwardly along transverse plane 146, which is defined by and extends from the abutting minor surfaces 130*a* (FIG. 1) of the two juxtaposed half-charges 142.

It will be noted that the configuration of the juxtaposed half-liners 128 (FIG. 2) show in longitudinal cross-sectional view a V-shaped profile, the apex of the V being sharp and a disappearingly small quantity of metal being contained at the very center of the apex. As is well-known to those skilled in the art, the metal half-liners 128 are pulverized and at least in part melted by the detonation of toroidal shaped charge 148 and the mass of pulverized/molten metal greatly enhances the penetrating power of the explosive jet engendered by the detonation.

Figure 3:
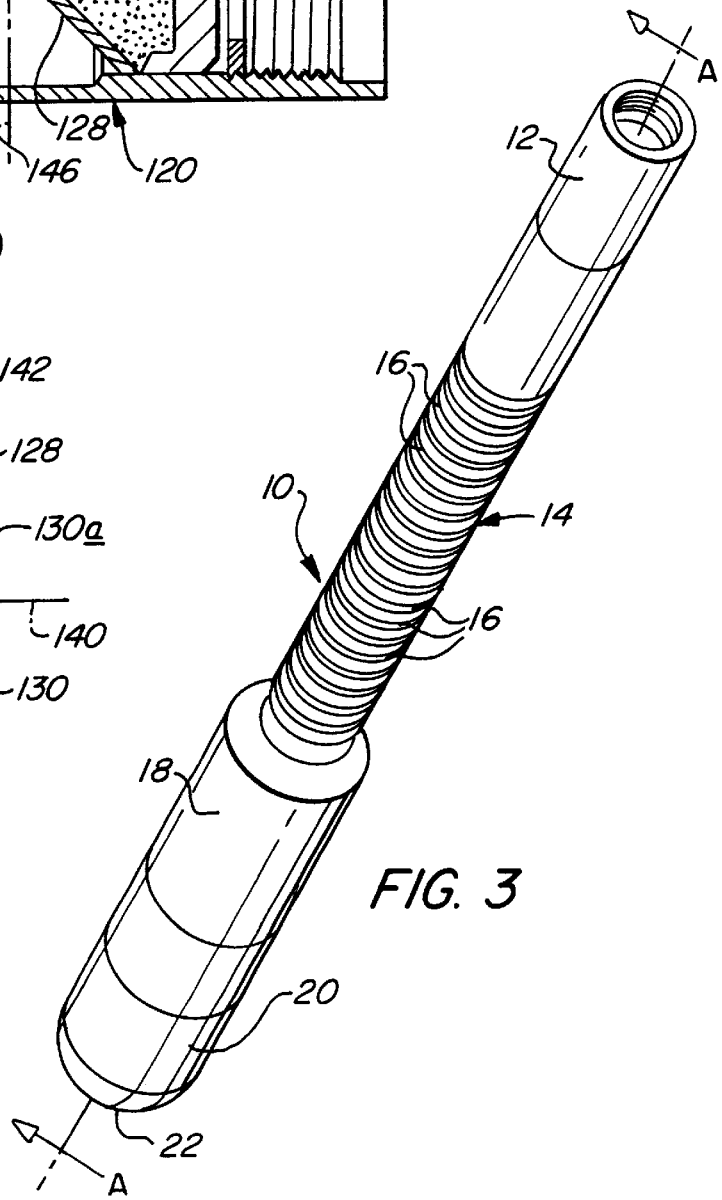
FIG. 3 is a perspective view of an explosive pipe cutting device in accordance with an embodiment of the present invention assembled with a conveyance sub, adapter and firing head.
Figure 3A:
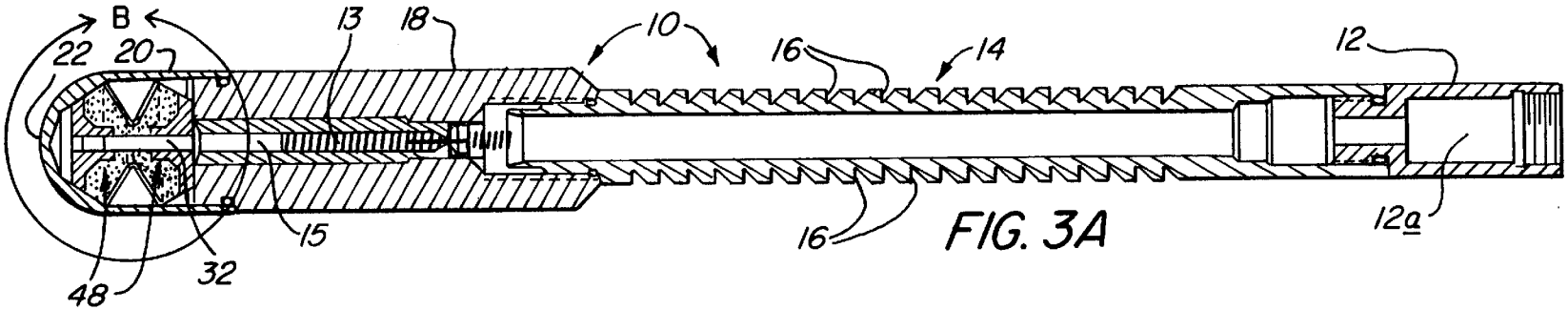
FIG. 3A is a cross-sectional view taken along line A—A of FIG. 3.

Referring now to FIGS. 3 and 3A, there is shown generally at 10 a cutter assembly comprising a firing head 12, an adapter 14 having a series of circumferential grooves 16 formed therein, a conveyance sub 18 and a housing 20 which, in accordance with an embodiment of the present invention, terminates in a hemispherical nose end 22. The firing head 12, adapter 14 and conveyance sub 18 of cutter assembly 10 are conventional and well-known in the art and therefore need not be described in detail. It suffices to say that firing head 12 contains the firing device schematically illustrated at 12*a* in FIG. 3A which, upon initiation, directs an electrical current through conductors (not shown) to ignite a fuse train 13 (FIG. 3A) which initiates a detonator 15, which in turn detonates a booster charge 32 (FIG. 3B) to thereby initiate toroidal shaped charge 48 contained within housing 20. As is well-known to those skilled in the art, adapter 14 serves as a shock absorber to attenuate the shock wave engendered by the explosion of toroidal shaped charge 48, the major force of which will emanate in a disc-like pattern radially outwardly along the transverse plane 46 shown in FIG. 3B. FIG. 3B shows a toroidal shaped charge 48 and other components contained within a housing 20 in accordance with an embodiment of the present invention, as described below.

Figure 3C:
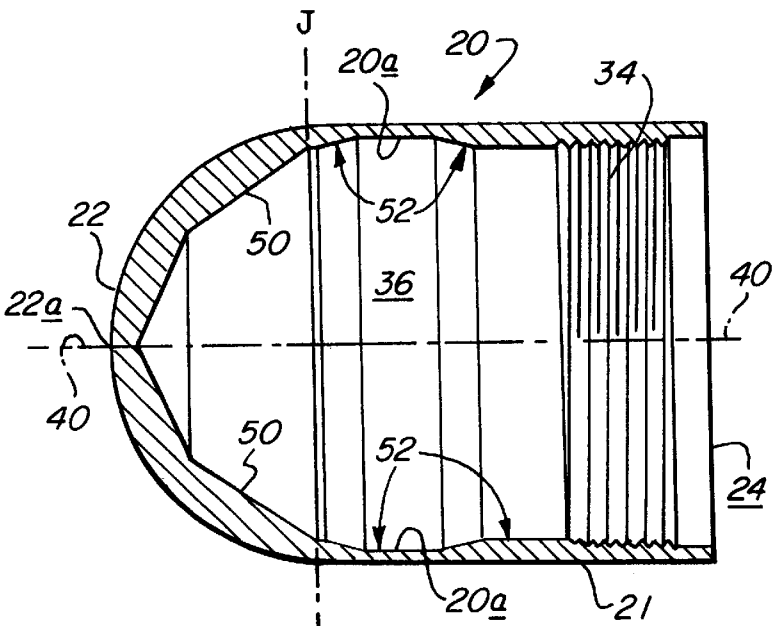
FIG. 3C is a view corresponding to that of FIG. 3B but showing the housing of the device empty, without the toroidal shaped charge or other components contained therein.
Figure 3B:
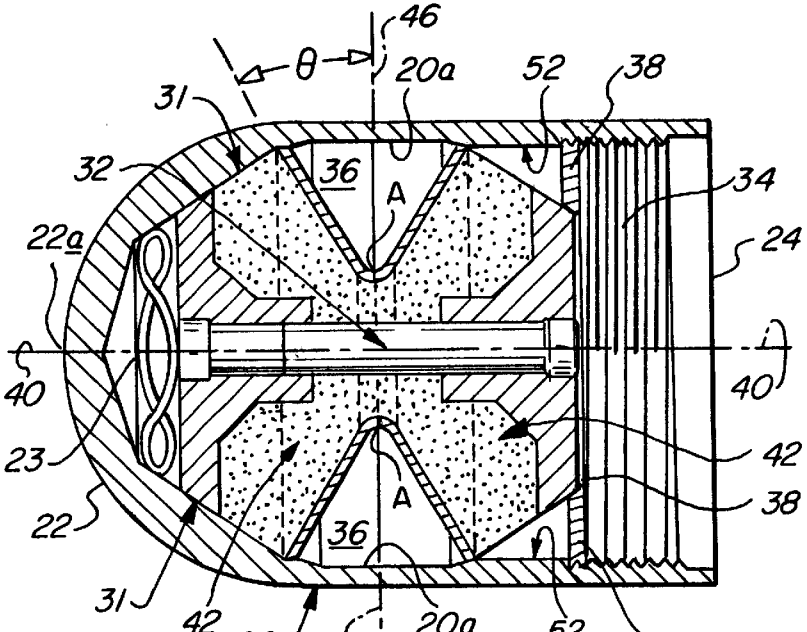
FIG. 3B is a view, enlarged relative to FIG. 3A, of the explosive pipe cutting device of the assembly of FIG. 3A, being the portion thereof enclosed within the arc B.

FIG. 3C depicts a cross-sectional view of the empty housing 20 of FIG. 3B. Housing 20 has a closed end provided by a hemispherical nose end 22 and an open end 24 and defines an enclosure 36 within which a toroidal shaped charge 48 may be received. Hemispherical nose end 22 is contiguous with a cylindrical section 21 of housing 20, which is symmetrical about a longitudinal axis 40 thereof. Housing 20 includes an internally threaded portion 34 at the open end 24 thereof The outer diameter of cylindrical section 21 is identical to that of hemispherical nose end 22 to provide a smooth transition at the juncture between hemispherical nose end 22 and cylindrical section 21. This juncture is indicated in FIG. 3C by a plane J—J taken perpendicularly to longitudinal axis 40. Nose end 22 is preferably hemispherical in shape because that shape maximizes the pressure resistance of housing 20 for a given wall thickness and material of construction, typically steel, e.g., hardened steel. Nose end 22 may, however, have a shape other than hemispherical, such as an arc of an ellipsoid or a shape like the head of a bullet or an otherwise tapered shape, wherein the point or smallest diameter portion of nose end 22 faces in the direction of downward travel of cutter assembly 10 into the well pipe. That is, the taper is such that the diameter of the exterior surface of nose end 22 decreases in the direction moving from its point of maximum diameter to the terminus 22*a* of nose end 22. In this case, the point of maximum diameter of nose end 22 occurs at the juncture (plane J—J) of hemispherical nose end 22 and cylindrical section 21. Such ellipsoidal, pointed or, preferably, hemispherical shape of nose end 22 facilitates the passage of cutter assembly 10 past any obstacles which may be encountered in the pipe as the cutter assembly is lowered therethrough, as well as providing enhanced pressure resistance to housing 20 as compared to prior art flat nose designs.

Housing 20 is of circular cross section, defines an enclosure 36 and has an interior surface generally indicated at 52, an interior portion of which adjacent open end 24 is threaded to provide threaded portion 34. A longitudinally extending segment of housing 20 has a thin-walled section 20*a*. The interior of nose end 22 is shaped to define a support shoulder 50 of truncated conical configuration.

Figure 3D:
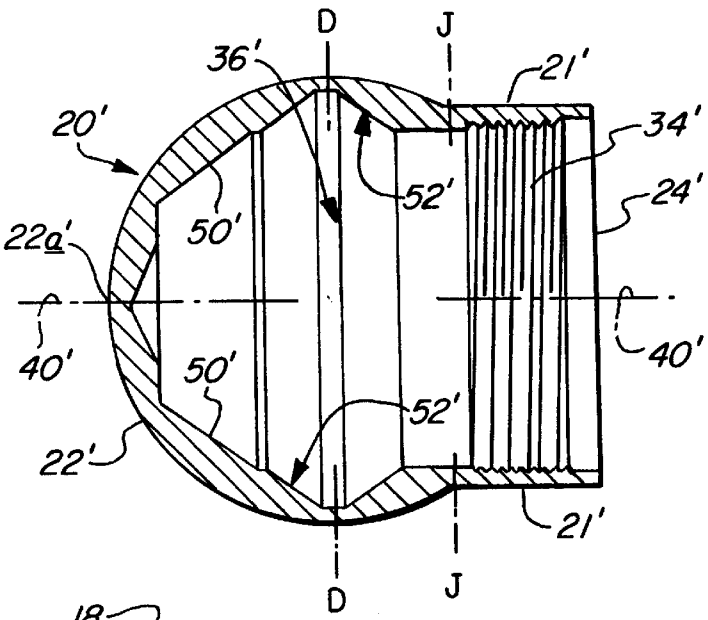
FIG. 3D is a view corresponding to FIG. 3C, but showing a different embodiment of the housing of the present invention.

FIG. 3D depicts a cross-sectional view of a housing 20' of another embodiment of the present invention. The components of housing 20' which correspond to those of the embodiment of FIG. 3C are numbered identically thereto except for the addition of a prime indicator. In this embodiment, housing 20' has a closed end provided by a hemispherical nose end 22' which terminates at its terminus 22*a*'. In contrast to the configuration of housing 20 of FIG. 3C, the spherical segment of which hemispherical nose end 22' is a part extends for a distance beyond nose end 22' towards open end 24' of housing 20', to the junction between the spherical segment and cylindrical section 21'. As in the case of FIG. 3C, this junction is indicated by a plane J—J taken perpendicularly to the longitudinal axis 40' of housing 20'. Stated otherwise, the leading portion of housing 20' (the left-hand portion, as viewed in FIG. 3D) is configured as a major segment, more than half, of a sphere. As with the embodiment of FIG. 3C, nose end 22' is tapered such that the diameter of the housing 20' decreases in the direction moving from its point of maximum diameter to the terminus 22*a*' of nose end 22'. The point of maximum diameter of housing 20' is indicated by a plane D—D taken perpendicularly to longitudinal axis 40' of housing 20'. As is the case with housing 20 of FIG. 3C, housing 20' is of circular cross section, defines an enclosure 36', and has an interior surface generally indicated at 52', an interior portion of which adjacent open end 24' is threaded to provide threaded portion 34'. The interior of nose end 22' is shaped to define a support shoulder 50' which is of truncated conical configuration.

Figure 4A:
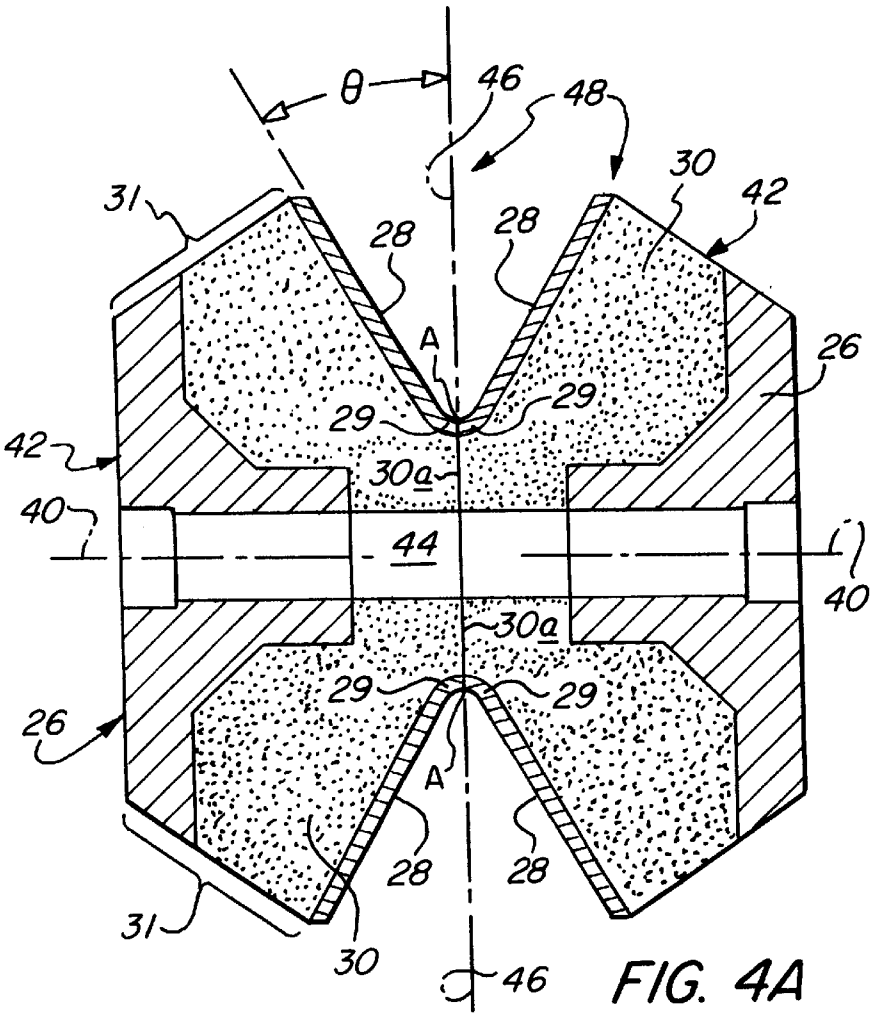
FIG. 4A is a cross-sectional view of two half-charges as illustrated in FIG. 4, assembled to provide a toroidal shaped charge in accordance with an embodiment of the present invention.
Figure 4:
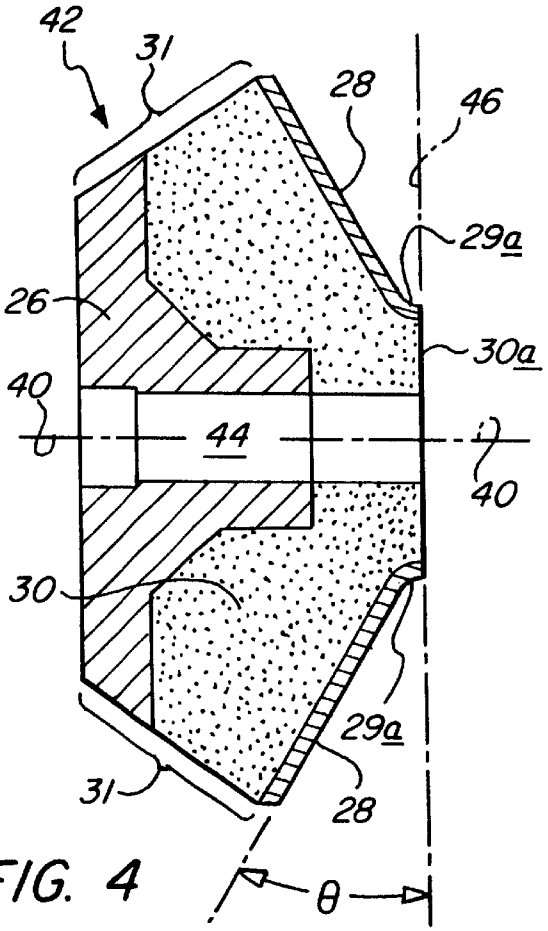
FIG. 4 is a cross-sectional view of a half-charge in accordance with one embodiment of the present invention.

FIG. 4 shows a symmetrical half-charge 42, which will provide one-half of the toroidal shaped charge 48 (FIG. 4A) of an embodiment of the present invention. Half-charge 42 is comprised of a backup plate 26, a half-liner 28 and an explosive charge 30 disposed between the half-liner 28 and the backup plate 26. A suitable adhesive may be used to join backup plate 26 and half-liner 28 to explosive charge 30. A passage extends through half-charge 42 and is numbered 44 as it will form a portion of passageway 44 in the assembled device. The circumferential portions of backup plate 26 and explosive charge 30 cooperate to define a seating surface 31 of half-charge 42, which seating surface is in the shape of a truncated cone and is congruent to support shoulder 50 on the interior of housing 20. Half-charge 42 has a flat minor surface 30*a* which lies in plane 46. The outer surface of half-liner 28 defines an angle θ with transverse plane 46.

Figure 5A:
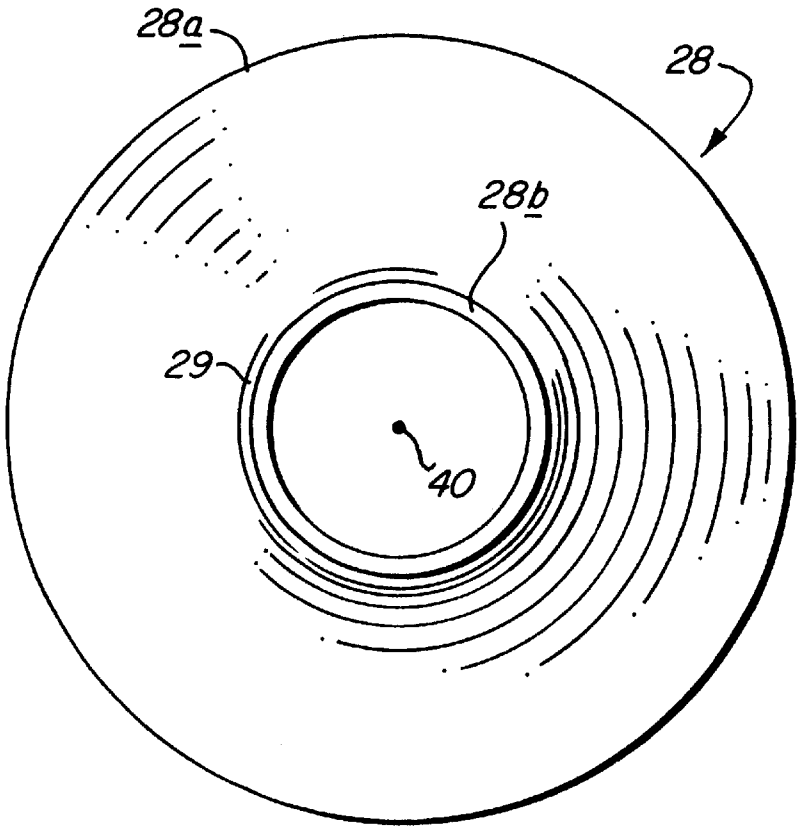
FIG. 5A is a front view of the half-liner of FIG. 5.
Figure 5:
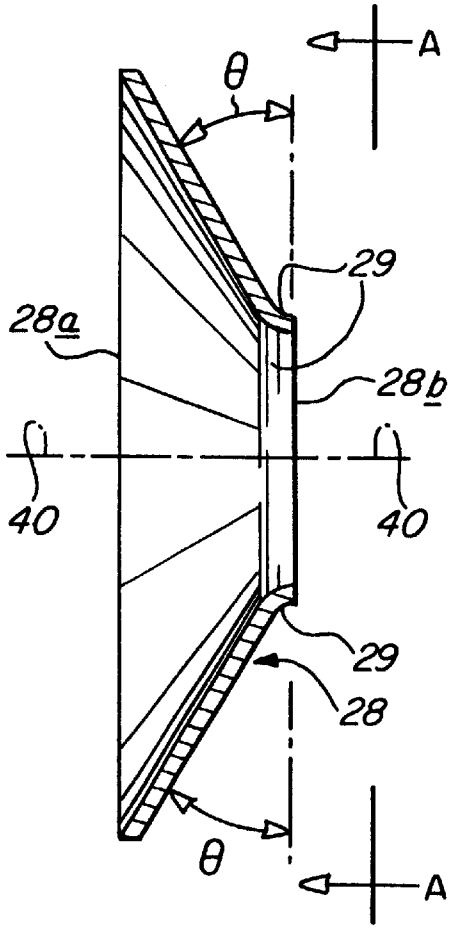
FIG. 5 is a cross-sectional side view of the half-liner of the half-charge of FIG. 4.

FIG. 5 is a cross-sectional view of the half-liner 28 of FIG. 4 which is generally in the shape of a truncated cone open at both its base end 28*a* and its truncated end 28*b*. FIG. 5A is an end view of the half-liner 28 taken along line A—A of FIG. 5. Truncated end 28*b* of the half-liner 28 is fashioned as a flange 29 which is turned to extend for a short distance in a generally axial direction, e.g., parallel or nearly parallel to longitudinal axis 40.

Figure 6:
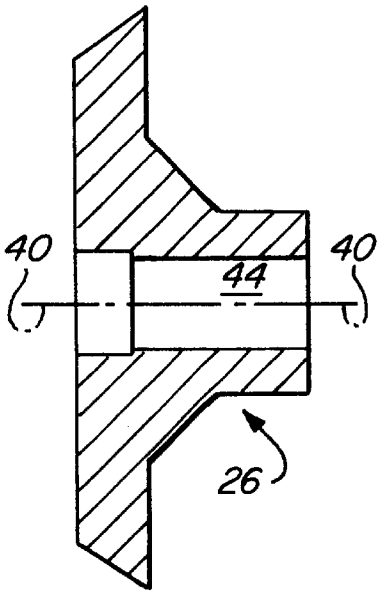
FIG. 6 is a cross-sectional view of the backup plate of the half-charge of FIG. 4.

FIG. 6 is a cross-sectional view of the backup plate 26 taken along longitudinal axis 40. Backup plate 26 includes an elongated passage which is numbered 44 as it will form part of passageway 44 in the assembled device. The elongated passage numbered 44 is coaxial with longitudinal axis 40, extends through backup plate 26*a* and explosive charge 30*a* (FIG. 4) and is dimensioned and configured to receive therein components as described below.

Reference is now made to FIG. 4A which is a cross-sectional view along longitudinal axis 40 of a first half-charge 42 juxtaposed with an identical half-charge 42 to provide a toroidal shaped charge 48 in accordance with an embodiment of the present invention. The two half-charges 42 are positioned in alignment with each other with their respective minor surfaces 30*a* abutting each other at transverse plane 46 to provide a toroidal shaped charge 48 which is symmetrical about transverse plane 46 and symmetrical about longitudinal axis 40, which is perpendicular to plane 46. A suitably chosen angle θ is defined between the outer surface of half-liner 28 and the transverse plane 46. Angle θ may, for example, be from about 25 to 35 degrees, e.g., about 30 degrees. The passages (numbered 44) of each of the half-charges 42 are coaxial when the two half-charges are aligned as shown in FIG. 4A, and provide for a single passageway 44 extending through toroidal shaped charge 48 coaxially along longitudinal axis 40. Passageway 44 is dimensioned and configured to receive therein certain components as described below. The half-liners 28 of the two half-charges 42 are symmetrical about the longitudinal axis 40 and contiguous with one another at the common plane 46 so as to form a substantially continuous, toroidal liner 28, 28. Flanges 29 of half-liners 28 cooperate to provide at their juncture an apex A which is curved in longitudinal cross-sectional view (a cross-sectional view taken along longitudinal axis 40). This structure provides a full cross-sectional thickness of the metal of half-liners 28 at the apex A and thereby increases the amount of liner metal at the apex A as compared to the prior art liner 128, 128 of FIG. 2.

Figure 7A:
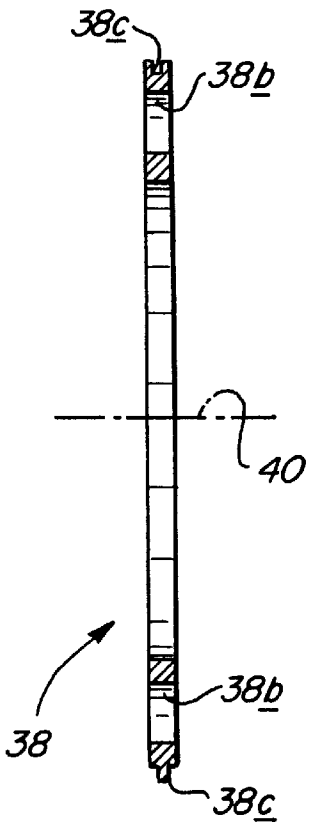
FIG. 7A is a cross-sectional side view of the retaining ring of FIG. 7.
Figure 7:
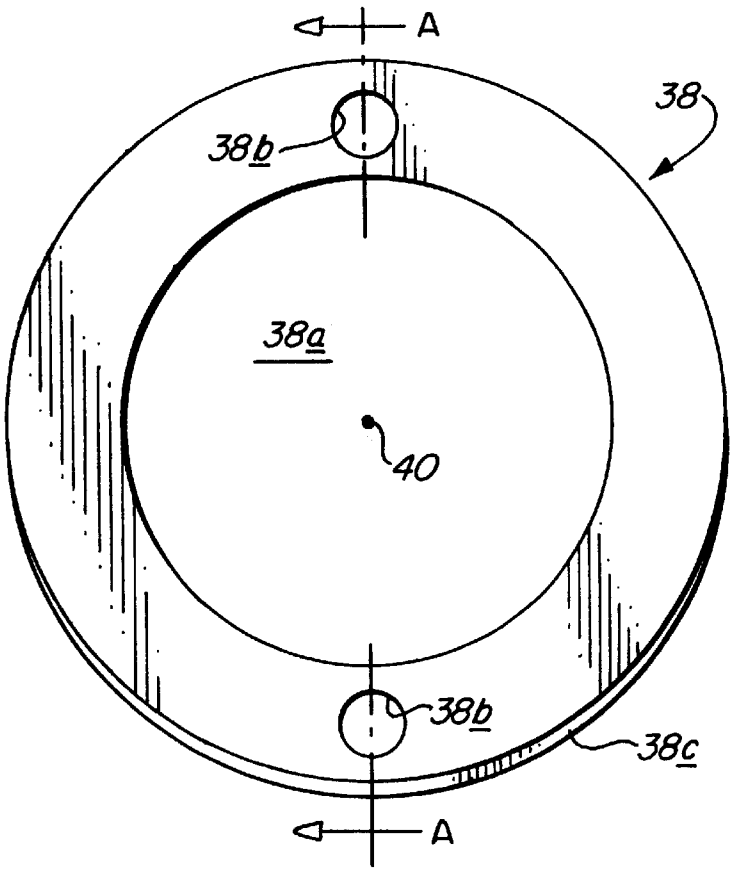
FIG. 7 is a front view of the retaining ring shown in FIG. 3B.

FIGS. 7 and 7A depict a retaining ring 38 comprising an essentially flat ring having a central opening 38*a*, a pair of peripheral apertures 38*b* disposed diametrically opposite each other and external thread 38*c*. FIG. 7A is a cross-sectional view of retaining ring 38 taken along longitudinal axis 40.

As best seen by reference to FIG. 4A and FIG. 3B, one half-charge 42 is disposed within the enclosure 36 of housing 20 such that the seating surface 31 thereof is seated flush upon support shoulder 50. The second half-charge 42 is placed upon the first half-charge 42, the two half-charges cooperating to provide toroidal shaped charge 48. Alternatively, the two half-charges 42 may be assembled and then placed as a unit within housing 20. Toroidal shaped charge 48 is secured within the enclosure 36 of housing 20 (FIG. 3C) by retaining ring 38 (FIG. 3B) which is received by a groove (unnumbered) formed in the interior surface of housing 20 at the inner end of threaded portion 34 of housing 20. A conventional wave washer spring 23 is compressed between toroidal shaped charge 48 and the interior surface of nose end 22 to force toroidal shaped charge 48 against retaining ring 38. FIG. 3B shows that the thin-wall section 20*a* of housing 20 is aligned with the toroidal shaped concave opening of toroidal shaped charged 48 to thereby offer less resistance to the explosive force emanating along transverse plane 46 (FIG. 3B).

Referring now to FIG. 7, the periphery of central opening 38*a* of retaining ring 38 engages (FIG. 3B) the peripheral portion of backup plate 26 of the second half-charge 42, i.e., the half-charge closest to open end 24, ensuring thereby proper alignment of the first and second shaped charges 42 along the longitudinal axis 40 to provide a symmetrical toroidal shaped charge 48. Peripheral apertures 38*b* serve to receive the ends of tightening tools used to emplace retaining ring 38 within housing 20 to seat and align the two half-charges 42 firmly within the enclosure 36 of housing 20 to provide closely controlled aligmnent of the two half-charges 42. Such alignment provides that the passages (numbered 44) of the first and second half-charges 42 are coaxial about the longitudinal axis 40 and with one another so as to subtend a single continuous elongated passageway 44 through the first and second half-charges 42. Elongated passageway 44 serves to receive (FIG. 3B) a booster charge assembly 32 which serves to detonate the first and second explosive charges 30 of toroidal shaped charge 48. Toroidal shaped charge 48 is secured within the enclosure 36' of housing 20' (FIG. 3D) by retaining ring 38' (FIG. 3E), which is threadably received in an interior groove (unnumbered) adjacent the inside edge of threaded portion 34' of housing 20'. Retaining ring 38' (FIG. 3E) is configured similarly to retaining ring 38 of FIG. 3B and functions in substantially the same manner to align half-charges 42 and retain toroidal shaped charge 48 in place. Therefore, the construction and function of retaining ring 38' need not be further described except to state that a spring-like conventional wave washer spring 23 forces toroidal shaped charge 48' against retaining ring 38'.

Figure 3E:
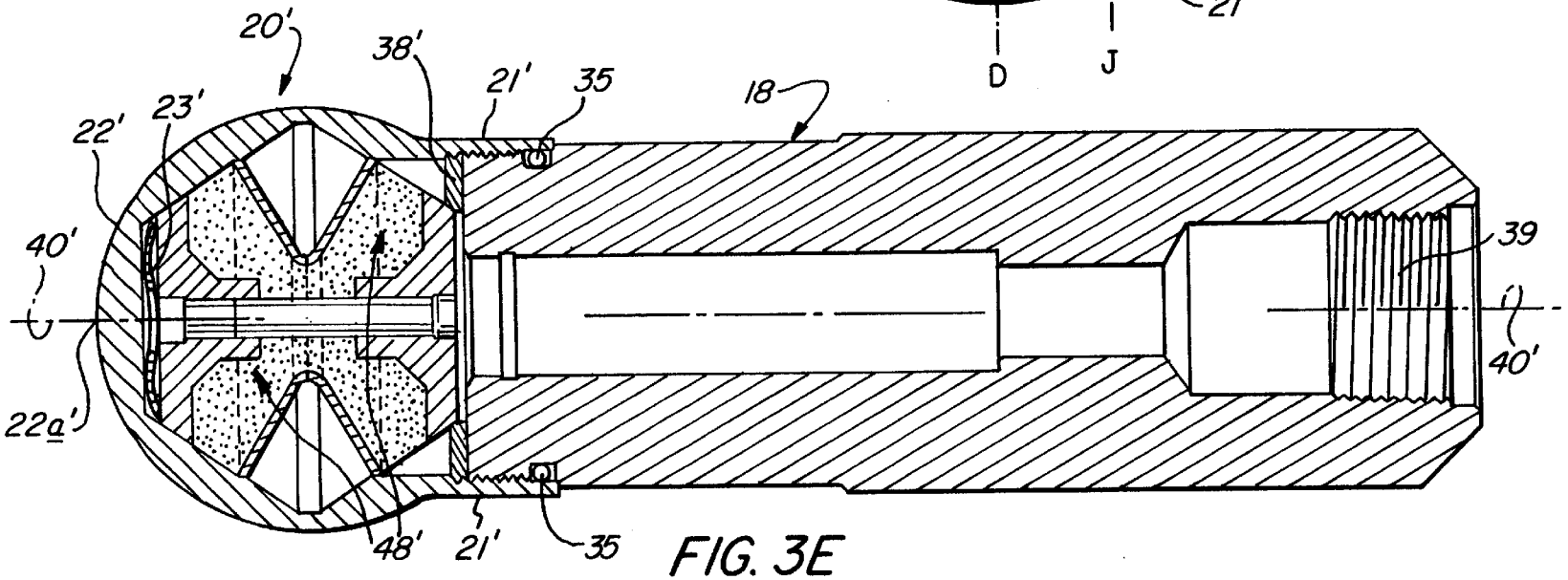
FIG. 3E is a cross-sectional longitudinal view of the housing of FIG. 3D attached to a conveyance sub.

The connection between conveyance sub 18 and housing 20' of FIG. 3E is substantially similar or identical to the connection between conveyance sub 18 and housing 20 shown in FIG. 3A. FIG. 3E shows that the portion of conveyance sub 18 connected to housing 20' has exterior threads (unnumbered) thereon which mate with the interior threads 34' of housing 20'. An O-ring gasket 35 is received within a peripheral groove (unnumbered) on conveyance sub 18 to seal the enclosure 36' (FIG. 3D) of housing 20' and the toroidal shaped charge 48 contained therein. Interior threads 39 of conveyance sub 18 serve to receive the end of adapter 14 (FIG. 3A) opposite from firing head 12. A similar sealing arrangement is used between housing 20 and conveyance sub 18 of FIG. 3A.

It will be evident to one skilled in the art that upon the detonation of toroidal shaped charge 48 a high velocity explosive jet containing molten and particulate metal of destroyed liner 28, 28 emanates outwardly from the longitudinal axis 40 along transverse plane 46 to provide a cutting force to sever a pipe within which the explosive cutting device is disposed.

The device of the present invention provides a number of advantages over prior art designs such as that illustrated in FIGS. 1 and 2. The tapered, preferably hemispherical, nose end of the housing (such as housing 20 of FIG. 3C or housing 20' of FIG. 3D) is able to withstand greater pressures than prior art flat-nosed devices of equivalent wall thickness and material of construction. The embodiment of FIG. 3D, wherein a segment of the housing is configured as a major segment of a sphere, is advantageous because, even as compared to the embodiment of FIG. 3C, a larger proportion of its structure is spherical. This provides further enhanced ability to withstand pressure for a housing of a given wall thickness and material of construction, as compared to an otherwise comparable, non-spherical structure. To this extent, the configuration of FIG. 3D is preferred. In any case, for a given resistance to pressure, thinner wall construction may be employed for the housings of the present invention than is the case with the prior art housings. Further, the tapered, preferably hemispherical, nose end is able to more easily maneuver past obstructions which may be encountered while the device is being lowered through the well pipe.

The flanged half-liners of the invention, when assembled to provide a toroidal shaped charge, concentrate more metal mass within the high velocity explosive jet emanating from the shaped charge than do the prior art V-shaped liners, as pointed out above. The construction of the housing, including the interior seating surface (such as support shoulder 50) at the nose end and the provision of a receiving recess or opening in the retaining ring, improves the alignment of the two half-charges contained within the enclosure.

While the invention has been described with reference to a specific embodiment thereof, it will be appreciated that numerous variations may be made to the illustrated specific embodiment which variations nonetheless lie within the spirit and scope of the invention.

What is claimed is:

1. An explosive pipe cutting device comprising:

a) a housing defining an enclosure and having a closed end and an opposite open end, the closed end defining a nose end which terminates in a terminus and has an exterior surface which is of tapered configuration and which diminishes in diameter in the direction moving towards the terminus of the nose end;

b) a toroidal shaped charge disposed within the enclosure of the housing, and having a front surface facing the nose end, an opposite, trailing surface facing the open end and a radially outwardly facing concave surface between the front surface and the trailing surface; and c) a retaining ring connected to the open end of the housing so as to secure the toroidal shaped charge within the housing.

2. The device of claim 1 wherein the nose end defines an exterior surface of curved configuration.

3. The device of claim 2 wherein the exterior surface is smoothly curved and the nose end constantly diminishes in diameter in the direction moving towards the terminus of the nose end.

4. The device of claim 1 wherein the nose end is of hemispherical configuration.

5. The device of claim 4 wherein the nose end comprises part of a major segment of a sphere.

6. The device of claim 5 wherein the housing further comprises a cylindrical section, one end of which defines the open end and from the other end of which the nose end extends, whereby the junction between the cylindrical section and the nose end is of lesser diameter than the diameter of the sphere.

7. The device of claim 4 wherein the closed end defines an interior seating surface on which the front surface of the toroidal shaped charge is seated.

8. The device of claim 1 wherein a retaining ring is disposed within the housing adjacent the open end thereof, the retaining ring engaging the trailing surface of the toroidal shaped charge.

9. The device of claim 1 wherein the toroidal shaped charge has a toroidal metal liner lining the concave surface thereof, the metal liner being dimensioned and configured to exhibit in longitudinal cross-sectional view a V-shape having a curved apex.

10. The device of claim 1 wherein the toroidal shaped charge is comprised of a pair of half-charges having mating surfaces and being juxtaposed to each other at their respective mating surfaces.

11. The device of claim 10 wherein the half-charges each have a metal half-liner lining a surface thereof, the metal half-liners being dimensioned and configured whereby when the half-charges are juxtaposed to each other within the housing to provide the toroidal shaped charge, the two metal half-liners cooperate to define a metal liner which lines the concave surface of the shaped charge and which is dimensioned and configured to exhibit in longitudinal cross-sectional view a V-shape having a curved apex.

12. A housing for an explosive pipe cutting device has a closed end and an opposite open end, the closed end defining a nose end which terminates in a terminus and has an exterior surface which is of tapered configuration and which diminishes in diameter in the direction moving towards the terminus of the nose end, the housing defining an enclosure which is dimensioned and configured to receive therein a toroidal shaped charge having a front surface facing the nose end, an opposite, trailing surface facing the open end and a radially outwardly facing concave surface between the front surface and the trailing surface.

13. The housing of claim 12 wherein the nose end defines an exterior surface of curved configuration.

14. The housing of claim 12 wherein the nose end is of hemispherical configuration.

15. The housing of claim 14 wherein the nose end comprises part of a major segment of a sphere.

16. The housing of claim 15 further comprising a cylindrical section, one end of which defines the open end and from the other end of which the nose end extends, whereby the junction between the cylindrical section and the nose end is of lesser diameter than the diameter of the sphere.

* * * * *